US005818000A

United States Patent [19]

Ma et al.

[11] Patent Number: 5,818,000

[45] Date of Patent: Oct. 6, 1998

[54] THREE-WAY SWITCH FOR PROTECTION OF A POWER AMPLIFIER DURING ANTENNA DISCONNECTION

[75] Inventors: Yawei Ma, Cary; Xue-Song Zhou, Chapel Hill, both of N.C.

[73] Assignee: Ericsson, Inc., Research Triangle Park, N.C.

[21] Appl. No.: 844,503

[22] Filed: Apr. 18, 1997

[51] Int. Cl.[6] ..... H01R 19/00

[52] U.S. Cl. ..... 200/51.03; 200/51.05; 200/275; 200/246

[58] Field of Search ..... 200/51.03, 51 R, 200/51.05, 51.06, 51.09, 51.1, 51.12, 239, 244, 245, 246, 275, 283, 284

[56] References Cited

U.S. PATENT DOCUMENTS 5,239,145 8/1993 Kusakabe ..... 200/51.1
5,685,418 11/1997 Chong et al. ..... 200/283
5,693,924 12/1997 Fetterolf, Sr. et al. ..... 200/51 R

*Primary Examiner*—David J. Walczak
*Attorney, Agent, or Firm*—Jenkens & Gilchrist, Professional Corp.

[57] ABSTRACT

A three-way switch for individually connecting either a dummy load, a first antenna, or a second antenna to a radio transmitter power amplifier output. The switch includes a first member connected to a dummy load and a second flexible member fixed in position relative to the first member and biased against the first member so as to make an electrical connection between the first and second member. The second member is connected to the radio transmitter output and includes two contact areas for connecting to a first and a second antenna. When a first antenna is applied against the first contact area, the transmitter is disconnected from the dummy load and only the first antenna is connected to the transmitter output. When a second antenna is applied to the second contact area the flexible member of the switch disconnects from the first antenna and only the second antenna is connected to the transmitter output.

4 Claims, 5 Drawing Sheets

THREE-WAY SWITCH FOR PROTECTION OF A POWER AMPLIFIER DURING ANTENNA DISCONNECTION

BACKGROUND OF THE INVENTION

1. Technical Field of the Invention

The present invention pertains in general to a three-way switch, and more particularly, to a three-way switch for individually connecting either a dummy load, a first antenna, or a second antenna to a radio transmitter in a mobile telephone.

2. Description of Related Art

It is often desirable to connect different antennas to a radio transmitter. When switching between different antennas, however, precautions must be taken to prevent damage to the power amplifier of the transmitter resulting from a mismatch in impedance between the transmitter output and the load across the transmitter output. Mismatches appearing at the output of the power amplifier lead to variations in the voltage standing wave ratio (VSWR) causing the power amplifier to change its operating condition. Such changes in the operation of the amplifier results in strong interference to adjacent channels or to an adjacent radio and reduces output power and efficiency. More importantly, high voltage standing wave ratio (VSWR) operation can cause permanent damage to power amplifiers. Such damage typically occurs when an antenna is disconnected during operation of the power amplifier. As the antenna is disconnected, an open condition appears across the output of the power amplifier and may induce a very high current surge in the power amplifier damaging its circuitry.

Several measures can be taken to avoid the interference to adjacent channels and to prevent permanent power amplifier damage under such open conditions. A first approach involves designing power amplifiers to tolerate a high voltage standing wave ratio while minimizing non-linear distortion. Such designs require a complex amplifier circuit resulting in increased cost and inefficient operation due to the requirement that the power amplifier provide high linearity (typically the higher the linearity of a power amplifier the lower the power efficiency of the power amplifier).

Another approach to avoid damage to the power amplifier is to add protection circuitry or protection components between the power amplifier and the antenna. Frequently, an isolator is added to reduce the effect of voltage standing wave variations which occur as one antenna is disconnected from the power amplifier and another is connected. Although this approach achieves relatively good performance, the use of an isolator in the transmitter circuit results in increased cost and size of the radio. It would be advantageous therefore, to devise an apparatus for connecting different antennas to a power amplifier of a transmitter which does not subject the power amplifier to an open condition.

SUMMARY OF THE INVENTION

The present invention comprises a three-way switch for connecting different antennas to an output of a radio transmitter. The switch includes a first member connected to a dummy load which has an impedance matching that of an antenna. The switch further includes a second flexible member fixed in position relative to the first member and biased against the first member so as to make an electrical connection between the first and second member. The second member is connected to the output of the transmitter. Thus, in situations where no antenna is connected to the switch, the transmitter output is connected to the dummy load. The second flexible member includes two contact areas for making connection to a first and a second antenna. When a lead of a first antenna is applied against the first contact area, the second flexible member moves away from its biased position in contact with the first member and the transmitter is disconnected from the dummy load. At that point, only the first antenna is connected to the transmitter output. When a lead of a second antenna is applied to the second contact area the first contact area of the second flexible member of the switch moves away from the contact lead of the first antenna. At that point, only the second antenna is connected to the transmitter output.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF EMBODIMENTS

Figure 1:
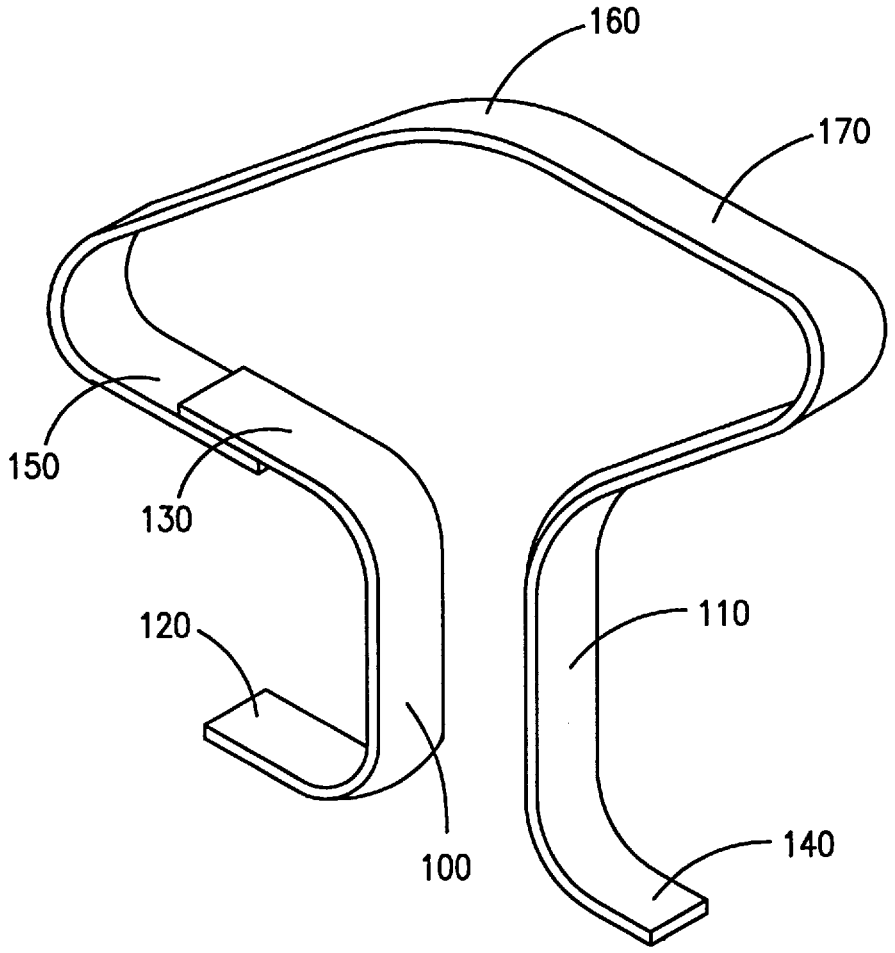
FIG. 1 is an orthogonal view of a switch comprising a preferred embodiment of the present invention.

Referring now to FIG. 1 there is illustrated an orthogonal view of a switch of the present invention including a first member 100 constructed of an electrically conductive material and a second member 110 constructed of a resilient flexible electrically conductive material. The first member 100 is formed into an arch like shape having a first end 120 and a second end 130. The second member 110 is formed into a looped shape with a first end 140 and a second end 150. The first end 140 of the second member 110 is fixed in position relative to the first member 100. The second end 150 of the second member 110 is normally biased against the inner arch area of the second end 130 of the first member 100 forming both a physical and electrical connection between the first member 100 and the second member 110.

The first member 100 is connected at end 120 to a dummy load (not shown) having an impedance matching that of an antenna. The second member 110 is connected at end 140 to an output of a transmitter power amplifier (not shown). Thus, the transmitter is connected to the dummy load via the first member 100 and second member 110 when no antennas are applied to the switch. The second member 110 includes a first contact area 160 and a second contact area 170 for effectuating an electrical and physical connection to a first antenna and a second antenna, respectively (not shown).

Figure 2:
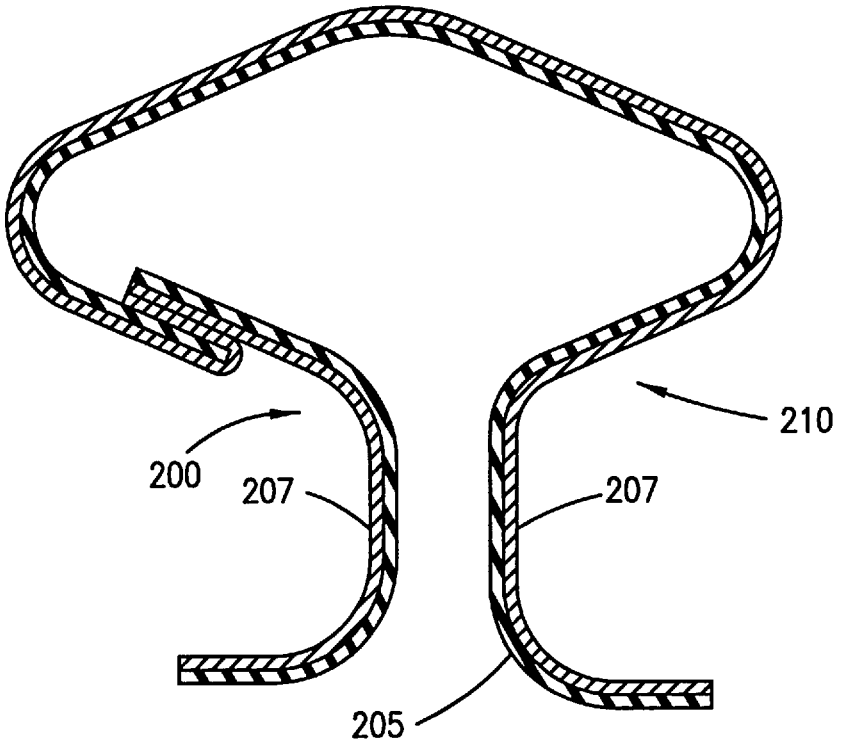
FIG. 2 is a view of a switch comprising an alternative embodiment of the present invention.

Referring additionally now to FIG. 2, there is illustrated an alternative embodiment of the present invention. Whereas the first member 100 and second member 110 of the embodiment depicted in FIG. 1 are constructed of an electrically conductive material, the first member 200 and the second member 210 of the alternative embodiment are constructed of a first material 205 coated with an electrically conductive material 207. The first material 205 can be any material and provides structural support for the switch. The electrically conductive material 207 provides an electrically conductive path between the first member 200 and the second member 210. Thus, when no antenna is connected to the switch the second member 207 is biased against the first member 200, thereby creating an electrical path between the first member 200 and the second member 210 via the electrically conductive coating 207.

Figure 3:
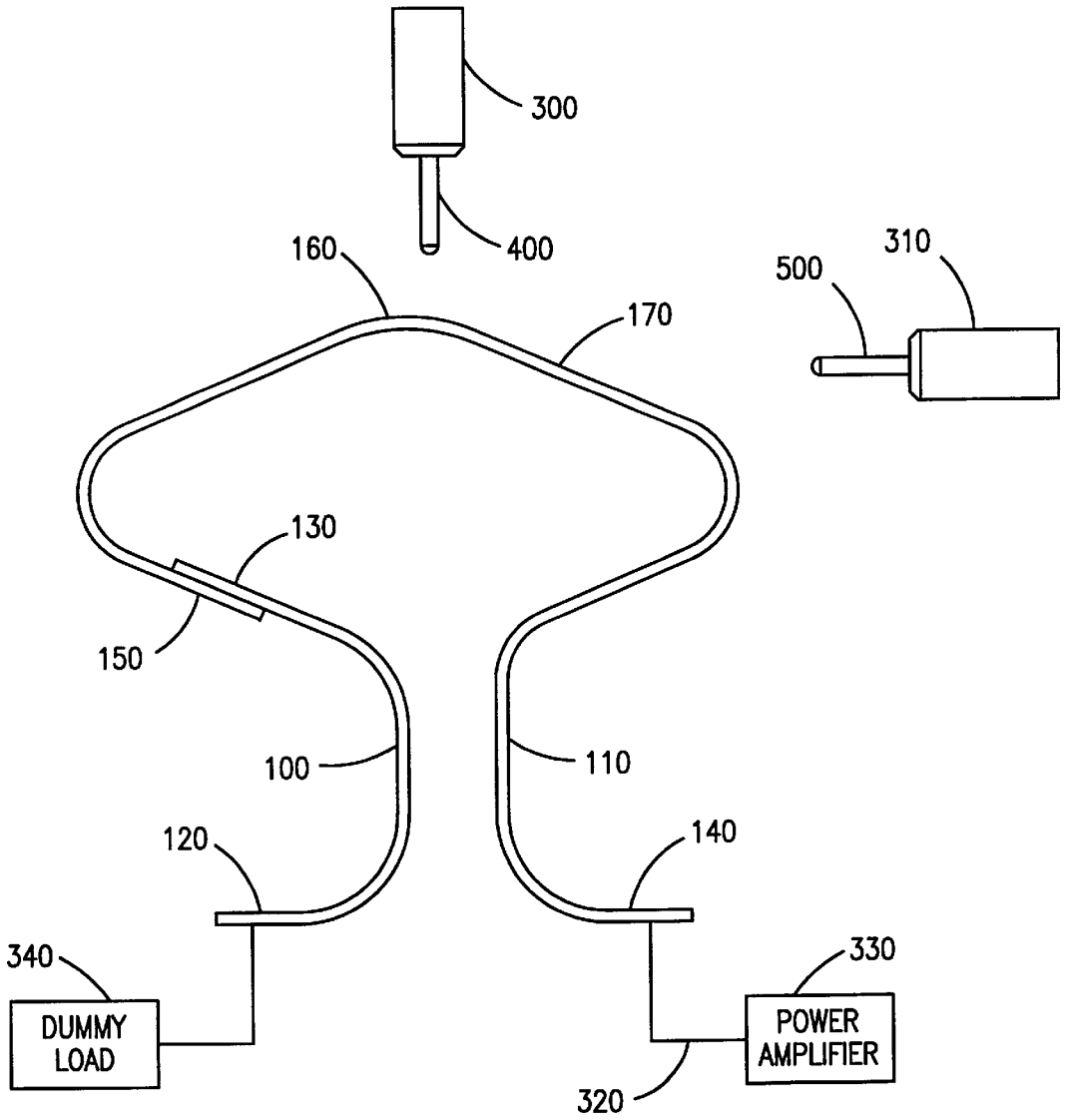
FIG. 3 is a side view of the preferred embodiment of the present invention shown in a first operating position where neither a first nor a second antenna as connected to the switch.

Referring additionally now to FIG. 3, there is illustrated a side view of the preferred embodiment of the present invention with neither a first antenna 300 nor a second antenna 310 applied against the first contact area 160 or the second contact area 170. The second end 150 of the second member 110 is thus biased against the second end 130 of the first member 100. Thus, the second member 110 which is connected to the transmitter output 320 from a power amplifier 330, and the first member 100 which is connected to a dummy load 340, are electrically connected.

Figure 4:
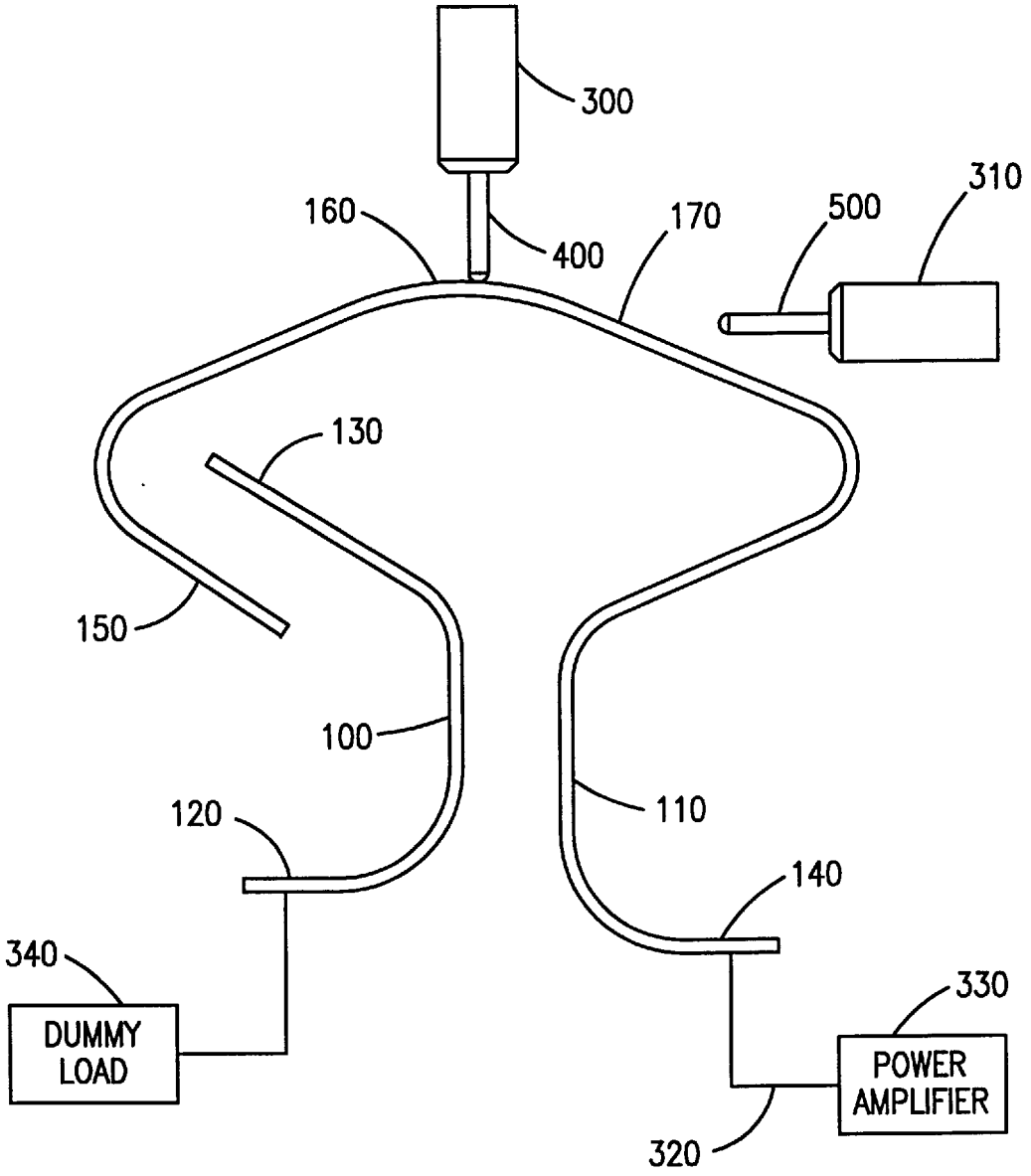
FIG. 4 is a side view of the preferred embodiment of the present invention shown in a second operating position with a first antenna connected to the switch.

Referring additionally now to FIG. 4, there is illustrated a side view of the preferred embodiment of the present invention where a center pin 400 of the first antenna 300 has been applied against the first contact area 160 of the second member 110. The force of the center pin 400 being applied against the first contact area 160 causes the second member 110 to flex and deflect the second end 150 away from the second end 130 of the first member 100. Therefore, the electrical and physical connection between the first member 100 and the second member 110 is broken. The second member 110 is now electrically and physically connected to the center pin 400. The first antenna 300 and the transmitter output 320 are now connected.

When the first antenna 300 is no longer applied against the first contact area 160, the resilient flexible member 110 returns to its normally biased position and electrical and physical contact is restored between the first member 100 and the second member 110. Thus, the transmitter output 320 is connected to the dummy load 340. See FIG. 3.

Figure 5:
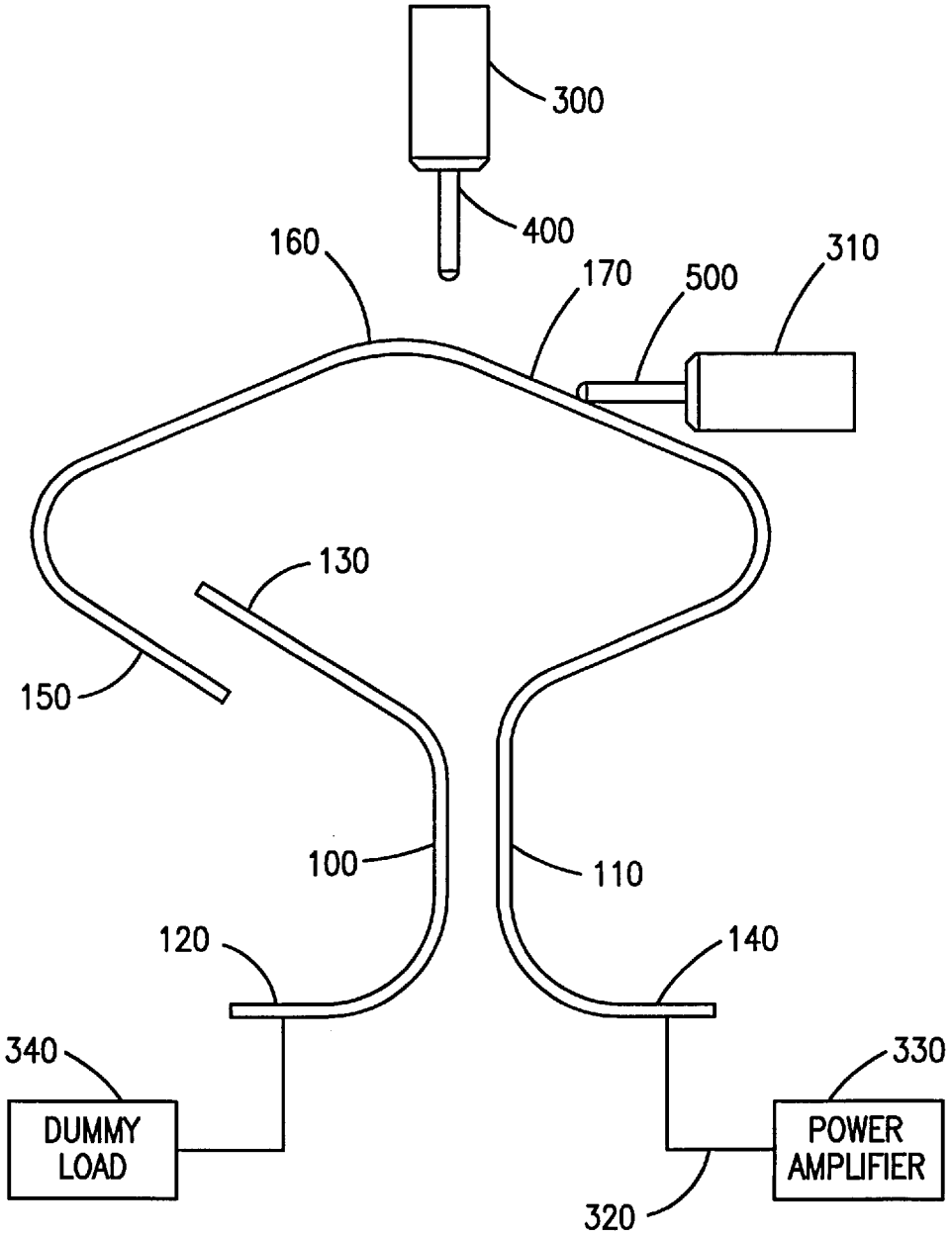
FIG. 5 is a side view of the preferred embodiment of the present invention shown in a third operating position with a second antenna connected to the switch.

Referring additionally now to FIG. 5, there is illustrated a side view of the preferred embodiment of the present invention where a center pin 500 of the second antenna 310 has been applied against the second contact area 170 of the second member 110. The force of the center pin 500 being applied against the second contact area 170 causes the looped second member 110 to flex and deflect the first contact area 160 away from the center pin 400 of the first antenna 300. The center pin 400 and the contact area 160 are now physically and electrically disconnected.

Furthermore, the force of the center pin 500 applied against the second contact area 170 causes the second member 110 to flex and deflect the second end 150 away from the second end 130 of the first member 100. Thus, there is no electrical or physical connection between the first member 100 and the second member 110. As a result of the center pin 500 of the second antenna 310 being applied to the second contact area 170, both the dummy load 340 and the first antenna 300 are disconnected from the transmitter output 320 and instead, the second antenna 310 is connected to the transmitter output 320.

When the second antenna 310 is no longer applied against the second contact area 170, the resilient flexible member 110 flexes back toward its normally biased position. If the first antenna 300 is positioned so as to be applied against the first contact area 160, the first antenna 300 will make electrical and physical contact with the first contact area 160 as the second antenna 310 is removed and thus, the transmitter output is connected to the first antenna 300. See, FIG. 4. Otherwise, if the first antenna 300 is not positioned so as to be applied against the first contact area 160, the resilient flexible member 110 flexes entirely back to its normally biased position and electrical and physical contact is restored between the first member 100 and the second member 110. Thus the transmitter output 320 is connected to the dummy load. See, FIG. 3.

As has been described, the switch comprising the present invention connects the transmitter output 320 to either the first antenna 300, the second antenna 310, or the dummy load 340. At no time is the transmitter output 320 connected to an open circuit.

Although the description of the preferred embodiment of the present invention describes the connection of a radio transmitter output being individually connected to either a dummy load, a first antenna, or a second antenna, it is understood that the switch of the present invention can be used to connect any device or lead individually to any other three devices or leads. Furthermore, although embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A switch for connecting a first lead to a second lead, a third lead, or a fourth lead comprising:

a first member electrically connected to the fourth lead; and a second member electrically connected to the first lead, the second member fixed in position near a first end thereof, the second member further being flexible and biased with its second end in physical and electrical contact with the first member, the second member bent to define:

a first contact area for making electrical and physical contact with a first conductor of an applied second lead, the physical contact between the first conductor and the first contact area causing the second member to be physically and electrically disconnected from the first member; and a second contact area for making electrical and physical contact with a second conductor of an applied third lead, the physical contact between the second conductor and the second contact area causing the second member to be physically and electrically disconnected from the first member and the applied second lead.

2. A switch for connecting a first antenna, a second antenna, and a dummy load to a transmitter output comprising:

a first member electrically connected to the dummy load; and a second member electrically connected to the transmitter output, the second member fixed in position near a first end thereof, the second member further being flexible and biased with its second end in physical and electrical contact with the first member, the second member bent to define:

a first contact area for making electrical and physical contact with a center pin of an applied first antenna, the physical contact between the center pin of the first antenna and the first contact area causing the second member to be physically and electrically disconnected from the dummy load; and a second contact area for making electrical and physical contact with a center pin of an applied second antenna, the physical contact between the center pin of the second antenna and the second contact area causing the second member to be physically and electrically disconnected from the dummy load and the applied first antenna.

3. A switch for connecting a first lead individually to a second lead, a third lead or a fourth lead comprising:

an arched member electrically connected to the first lead;

a looped member electrically connected to the second lead and comprised of a resilient flexible material shaped to loop around the arched member such that electrical and physical contact is made between the arched member and the looped member;

a first electrical contact area on the looped member for making electrical and physical contact between the looped member and an applied third lead, the physical contact between the applied third lead and the first contact area causing the looped member to be electrically and physically disconnected from the arched member; and a second electrical contact area on the looped member for making electrical and physical contact between the looped member and an applied fourth lead, the physical contact between the applied fourth lead and the second contact area causing the looped member to be electrically and physically disconnected from the arched member and the applied third lead.

4. The switch of claim 3, wherein the arched member and the looped member are constructed of a non-electrically conductive material and coated with a conductive material.

* * * * *